US010005123B2

(12) United States Patent
Thornton et al.

(10) Patent No.: US 10,005,123 B2
(45) Date of Patent: Jun. 26, 2018

(54) LOST CORE MOLDING CORES FOR FORMING COOLING PASSAGES

(71) Applicant: UNITED TECHNOLOGIES CORPORATION, Hartford, CT (US)

(72) Inventors: Lane Thornton, Meriden, CT (US); San Quach, East Hartford, CT (US); Steven Bruce Gautschi, Naugatuck, CT (US)

(73) Assignee: United Technologies Corporation, Farmington, CT (US)

( * ) Notice: Subject to any disclaimer, the term of this patent is extended or adjusted under 35 U.S.C. 154(b) by 141 days.

(21) Appl. No.: 15/022,745

(22) PCT Filed: Sep. 26, 2014

(86) PCT No.: PCT/US2014/057574

§ 371 (c)(1),
(2) Date: Mar. 17, 2016

(87) PCT Pub. No.: WO2015/060989

PCT Pub. Date: Apr. 30, 2015

(65) Prior Publication Data

US 2016/0228941 A1 Aug. 11, 2016

Related U.S. Application Data

(60) Provisional application No. 61/894,928, filed on Oct. 24, 2013.

(51) Int. Cl.
*B22C 9/10* (2006.01)
*B22C 9/24* (2006.01)

(52) U.S. Cl.
CPC ..... *B22C 9/103* (2013.01); *B22C 9/24* (2013.01)

(58) Field of Classification Search
CPC combination set(s) only.
See application file for complete search history.

(56) References Cited

U.S. PATENT DOCUMENTS 5,951,256 A 9/1999 Dietrich
6,929,054 B2 * 8/2005 Beals ..... B22C 7/02 164/365

(Continued)

FOREIGN PATENT DOCUMENTS

EP 1611978 1/2006
EP 1634665 A2 3/2006

(Continued)

OTHER PUBLICATIONS

International Preliminary Report on Patentability for International Application No. PCT/US2014/057574 dated May 6, 2016.

(Continued)

*Primary Examiner* — Kevin E Yoon
(74) *Attorney, Agent, or Firm* — Carlson, Gaskey & Olds, P.C.

(57) ABSTRACT

In a featured embodiment, a lost core assembly includes a ceramic component having a tapered shape in a radial direction. A refractory metal component extends radially from the ceramic core component. A method of molding a gas turbine engine component is also disclosed.

16 Claims, 2 Drawing Sheets

(56) References Cited

U.S. PATENT DOCUMENTS

| | | | | |
|---|---|---|---|---|
| 6,932,571 | B2 * | 8/2005 | Cunha | F01D 5/18 416/97 R |
| 8,302,668 | B1 | 11/2012 | Bullied et al. | |
| 2006/0048914 | A1 | 3/2006 | Wiedemer et al. | |
| 2007/0068649 | A1 | 3/2007 | Verner | |
| 2007/0221359 | A1 | 9/2007 | Reilly | |
| 2008/0008599 | A1 * | 1/2008 | Cunha | F01D 5/186 416/97 R |
| 2008/0131285 | A1 | 6/2008 | Albert et al. | |
| 2008/0169412 | A1 | 7/2008 | Snyder et al. | |
| 2008/0181774 | A1 | 7/2008 | Cunha | |
| 2011/0286857 | A1 | 11/2011 | Gleiner | |
| 2011/0315336 | A1 | 12/2011 | Snyder et al. | |
| 2012/0168108 | A1 | 7/2012 | Farris | |

FOREIGN PATENT DOCUMENTS

| | | | |
|---|---|---|---|
| EP | 1914030 | | 4/2008 |
| EP | 1923152 | A1 | 5/2008 |
| EP | 1952911 | A1 | 8/2008 |
| EP | 2191911 | A1 | 6/2010 |
| EP | 2399693 | A2 | 12/2011 |

OTHER PUBLICATIONS

International Search Report from corresponding PCT /US14/57574.
Singapore Search Report for Singapore Application No. 11201601945Y dated Aug. 18, 2016.
Supplementary European Search Report for European Application No. 14856477.6 dated Jun. 27, 2017.

* cited by examiner

LOST CORE MOLDING CORES FOR FORMING COOLING PASSAGES

CROSS-REFERENCE TO RELATED APPLICATION

This application claims priority to U.S. Provisional Application No. 61/894,928, filed Oct. 24, 2013.

BACKGROUND OF THE INVENTION

This application relates to a core for forming cooling passages in an airfoil, wherein the core is formed of ceramic components and refractory metal components.

Gas turbine engines are known and, typically, include a number of airfoils. The airfoils may be utilized as turbine blades, turbine vanes, compressor blades and vanes, and at other locations.

As known, in a gas turbine engine, temperatures can become quite high and, thus, cooling passages may be required within the airfoils. One method of forming the cooling passages is so-called lost core molding. In lost core molding, a core is formed and placed within a mold for forming the airfoil. Metal is injected into the mold and solidifies around the core. The core is then leached away leaving internal cavities within the airfoil.

One type of material utilized for the core is ceramics. Ceramics are useful in that they can be made to taper. However, it is difficult to make ceramics into relatively thin shapes.

Another type of core component is formed of refractory metals. Such materials can be made to be quite thin, however, they are limited in being able to form tapering passages.

It has been proposed to utilize the combination of ceramics and refractory metals, however, this has only been done with the refractory metals extending in an axial direction from the ceramic core materials.

SUMMARY OF THE INVENTION

In a featured embodiment, a lost core assembly includes a ceramic component having a tapered shape in a radial direction. A refractory metal component extends radially from the ceramic core component.

In another embodiment according to the previous embodiment, the ceramic component tapered shape has a first end of a first area and a second end of a second smaller area. Sides of the ceramic component taper between the first and the second ends. The refractory metal component is secured to the second end.

In another embodiment according to any of the previous embodiments, the ceramic component has slots on the second end. The refractory metal component extends into the slots.

In another embodiment according to any of the previous embodiments, a glue is positioned in the slots to secure the refractory metal component to the ceramic component.

In another embodiment according to any of the previous embodiments, there are a plurality of ceramic components secured to the refractory metal components.

In another embodiment according to any of the previous embodiments, there are a plurality of refractory metal components secured to the ceramic component.

In another embodiment according to any of the previous embodiments, the refractory metal component extends for a greater distance in a direction from the first face to the second face of the ceramic core component and is thinner than the ceramic core component in a second direction perpendicular to the first direction.

In another embodiment according to any of the previous embodiments, the refractory metal component extends for a greater distance in a direction from the first face to the second face of the ceramic core component and is thinner than the ceramic core component in a second direction perpendicular to the first direction.

In another embodiment according to any of the previous embodiments, a glue secures the ceramic components to the refractory metal component.

In another embodiment according to any of the previous embodiments, there are a plurality of ceramic components secured to the refractory metal component.

In another embodiment according to any of the previous embodiments, there are a plurality of refractory metal components secured to the ceramic component.

In another embodiment according to any of the previous embodiments, a glue secures the ceramic components to the refractory metal component.

In another featured embodiment, a method of molding a gas turbine engine component includes the step of inserting a core assembly into a mold for a gas turbine engine component. The component has a ceramic component with a tapered shape in a radial direction. A refractory metal component extends radially from the ceramic core component.

In another embodiment according to the previous embodiment, a first end of a first area and a second end of a second smaller area. Sides of the ceramic component taper between the first and the second end In another embodiment according to any of the previous embodiments, the ceramic component has slots on the second end. The refractory metal component extends into the slots.

In another embodiment according to any of the previous embodiments, a glue is positioned in the slots to secure the refractory metal component to the ceramic component.

In another embodiment according to any of the previous embodiments, the refractory metal component extends for a greater distance in a direction from the first face to the second face of the ceramic core component and is thinner than the ceramic core component in a second direction perpendicular to the first direction.

In another embodiment according to any of the previous embodiments, a glue secures the ceramic components to the refractory metal component.

In another embodiment according to any of the previous embodiments, there are a plurality of ceramic components secured to the refractory metal component.

In another embodiment according to any of the previous embodiments, there are a plurality of refractory metal components secured to the ceramic component.

These and other features may be best understood from the following drawings and specification.

DETAILED DESCRIPTION

Figure 1:
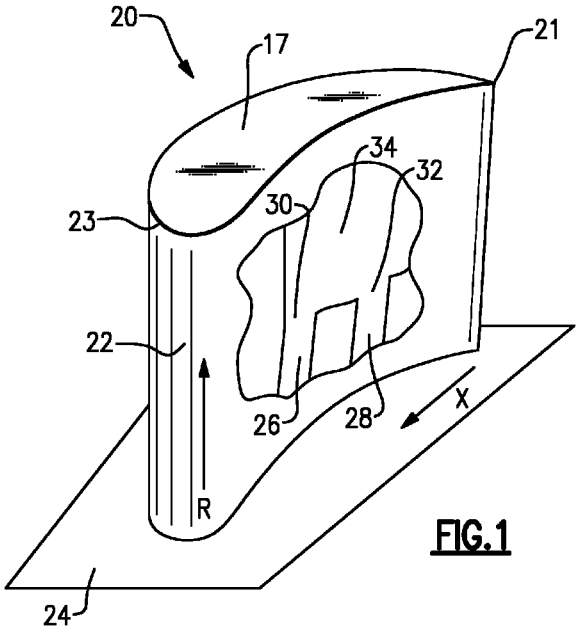
FIG. 1 shows a gas turbine engine component.

A gas turbine engine component 20 is illustrated in FIG. 1 and may have an airfoil 22 extending away from a platform 24. The airfoil extends from a leading edge 23 to a trailing edge 21. An axial direction X is defined between the trailing edge 21 and leading edge 23. A radial direction R is defined as extending away from the platform 24 to the tip 17 of the airfoil 22. In the cutaway view of FIG. 1, internal cooling passages are shown. Tapered passages 26 and 28 feed air upwardly from supplies beyond the platform 24 into plug connectors 30 and 32, and then into a thin passage 34 extending through the height of the airfoil 22 in the radial direction.

It is desirable to have the passages 26 and 28 taper, but have the passage at 34 be thin.

Figure 2A:
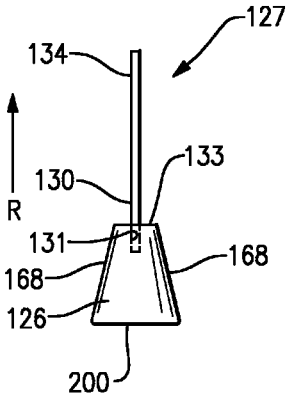
FIG. 2A shows a first view of a core assembly.

Thus, as shown in FIG. 2A, a first ceramic component 126 is utilized to form a core assembly 127 in combination with a refractory metal component metal 134. A plug 130 is shown plugged into a slot 131 (shown in phantom) in an upper surface 133 of the ceramic component 126.

Figure 2B:
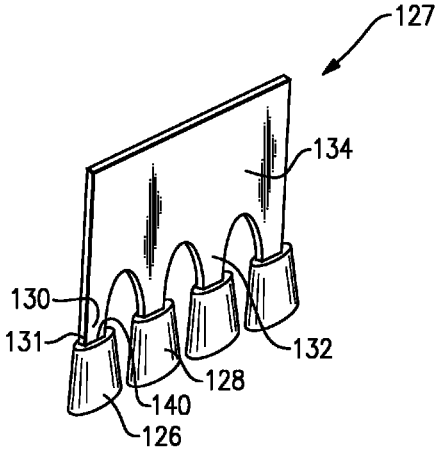
FIG. 2B shows another view of the core assembly.

As shown in FIG. 2B, there may be a plurality of the plugs 130, 132 plugged into a plurality of tapering components 126, 128. The slot 131 may receive a ceramic glue 140 as known to secure the refractory metal component 134 to the ceramic component 128.

Figure 3:
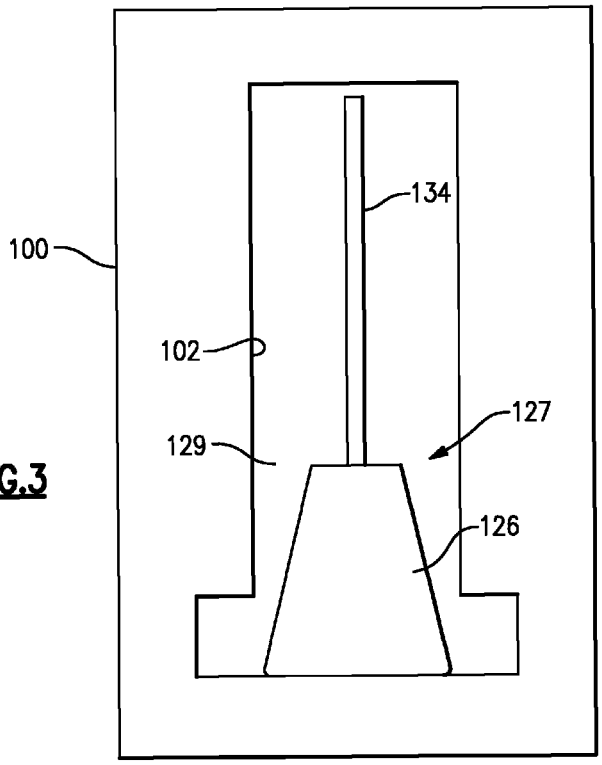
FIG. 3 schematically shows a molding assembly for forming the airfoil of FIG. 1.

FIG. 3 schematically shows a mold 100. As known, a mold core 102 is positioned to receive the core assembly 127. Metal is injected into a cavity 129 about the core assembly 127 and then allowed to solidify. Once the metal has solidified, the core assembly 127 is leached away leaving internal cavities as shown in FIG. 1.

After manufacture, a component formed in mold 100 may be mounted in a gas turbine engine.

As can be appreciated from the Figures, the refractory metal component 134 extends radially away from the ceramic component 126. As can also be appreciated, the ceramic component 126 tapers or become smaller in the radial direction R as shown by the tapering sides.

Lost core assembly 127 includes a ceramic component 126 having a first end 200 of a first area and a second end 133 of a second smaller area. Sides 168 of the component taper between the first and second ends. A refractory metal component 134 extends from the second end of component 126.

While the radially outer second end 33 is disclosed as having a smaller area, all that is required is there be some taper in the shape in a radial direction. In embodiment, the first end 200 first area and the second end 133 second area could be of equal areas. For that matter, the second area could be larger than the first area.

Figure 4:
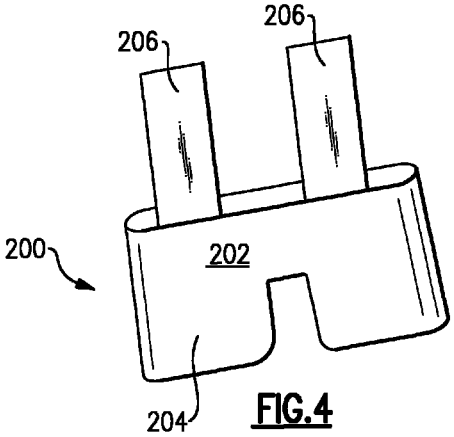
FIG. 4 shows another embodiment.

As shown in FIG. 4, in another embodiment, the lost core assembly 200 may include a single ceramic component 202 having a shape at area 204 similar to that of the ceramic components 126. There are a plurality of refractory metal components 206, which are shaped thin like the component 134.

The refractory metal component 134 extends for a greater distance in a direction from the first face end to the second end of the ceramic component 126 and is thinner than the ceramic component 126 in a second direction perpendicular to the first direction.

The ceramic and refractory metal materials may be as known in lost core molding techniques.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A method of molding a gas turbine engine component comprising the steps of:

inserting a core assembly into a mold for a gas turbine engine component, the core assembly having a ceramic component with a tapered shape in a radial direction;

a refractory metal component extending radially from said ceramic core component; and injecting metal into a cavity in said mold, and about the core assembly, allowing the metal to solidify, and removing the core assembly, leaving an internal cavity in a component formed in said mold, said component having an airfoil extending from a leading edge to a trailing edge, and in said radial direction away from a platform.

2. The method as set forth in claim 1, wherein a first end of a first area and a second end of a second smaller area, and sides of said ceramic component tapering between said first and said second end.

3. The method as set forth in claim 2, wherein said ceramic component having slots on said second end and said refractory metal component extending into said slots.

4. The method as set forth in claim 3, wherein a glue is positioned in said slots to secure said refractory metal component to said ceramic component.

5. The method as set forth in claim 2, wherein said refractory metal component extending for a greater distance in a direction from said first face to said second face of said ceramic core component and is thinner than said ceramic core component in a second direction perpendicular to said first direction.

6. The method as set forth in claim 1, wherein a glue secures said ceramic components to said refractory metal component.

7. The method as set forth in claim 1, wherein there are a plurality of ceramic components secured to said refractory metal component.

8. The method as set forth in claim 1, wherein there are a plurality of refractory metal components secured to said ceramic component.

9. A method of molding a gas turbine engine component comprising the steps of:

inserting a core assembly into a mold for a gas turbine engine component, the core assembly having a ceramic component with a tapered shape in a radial direction;

a refractory metal component extending radially from said ceramic core component; and injecting metal into a cavity in said mold, and about the core assembly, allowing the metal to solidify, and removing the core assembly, leaving an internal cavity in a component formed in said mold, said radial direction being defined as it will be when the component is mounted in an engine.

10. The method as set forth in claim 9, wherein a first end of a first area and a second end of a second smaller area, and sides of said ceramic component tapering between said first and said second end.

11. The method as set forth in claim 10, wherein said ceramic component having slots on said second end and said refractory metal component extending into said slots.

12. The method as set forth in claim 11, wherein a glue is positioned in said slots to secure said refractory metal component to said ceramic component.

13. The method as set forth in claim 10, wherein said refractory metal component extending for a greater distance in a direction from said first face to said second face of said ceramic core component and is thinner than said ceramic core component in a second direction perpendicular to said first direction.

14. The method as set forth in claim 9, wherein a glue secures said ceramic components to said refractory metal component.

15. The method as set forth in claim 9, wherein there are a plurality of ceramic components secured to said refractory metal component.

16. The method as set forth in claim 9, wherein there are a plurality of refractory metal components secured to said ceramic component.

* * * * *